US006971142B2

(12) United States Patent
Lautenschläger

(10) Patent No.: US 6,971,142 B2
(45) Date of Patent: Dec. 6, 2005

(54) MOUNTING PLATE FOR ADJUSTABLY RETAINING FURNITURE HINGES ON THE BODY OF PIECES OF FURNITURE

(75) Inventor: Gerhard Wilhelm Lautenschläger, Brensbach (DE)

(73) Assignee: Mepla-Werke Lautenschlager GmbH & Co.KG., Reinheim (DE)

( * ) Notice: Subject to any disclaimer, the term of this patent is extended or adjusted under 35 U.S.C. 154(b) by 0 days.

(21) Appl. No.: 10/485,692

(22) PCT Filed: Dec. 10, 2002

(86) PCT No.: PCT/EP02/13979

§ 371 (c)(1),
(2), (4) Date: Feb. 3, 2004

(87) PCT Pub. No.: WO03/052224

PCT Pub. Date: Jun. 26, 2003

(65) Prior Publication Data

US 2004/0194255 A1 Oct. 7, 2004

(30) Foreign Application Priority Data

Dec. 14, 2001 (DE) ..... 201 20 238 U

(51) Int. Cl.[7] ..... E05D 5/00
(52) U.S. Cl. ..... 16/382; 16/242; 16/249; 16/272; 16/257
(58) Field of Search ..... 16/382, 236–239, 16/242, 243, 246, 249, 272, 257, 258

(56) References Cited

U.S. PATENT DOCUMENTS 4,104,762 A * 8/1978 Rock et al. ..... 16/237
4,142,271 A * 3/1979 Busse ..... 16/238
4,227,284 A * 10/1980 Zernig ..... 16/238
4,642,846 A * 2/1987 Lautenschlager ..... 16/382
4,718,143 A * 1/1988 Lautenschlager, Jr. ..... 16/238
4,847,947 A * 7/1989 Tsong-Chi ..... 16/238
4,862,556 A * 9/1989 Grass ..... 16/382
4,982,476 A * 1/1991 Salice ..... 16/382
5,295,282 A * 3/1994 Lautenschlager ..... 16/237
5,603,142 A * 2/1997 Dubach et al. ..... 16/247
5,611,113 A * 3/1997 Rock et al. ..... 16/246
5,964,010 A * 10/1999 Huber ..... 16/237
6,145,164 A * 11/2000 Ferrari et al. ..... 16/242

(Continued)

FOREIGN PATENT DOCUMENTS

AT 001 973 U1 2/1998

(Continued)

*Primary Examiner*—Chuck Y. Mah
(74) *Attorney, Agent, or Firm*—Norris McLaughlin & Marcus PA

(57) ABSTRACT

Mounting plate (10) which can be fixed on the supporting wall of the carcass of a piece of furniture for adjustably retaining the bracket of a furniture hinge, wherein the said mounting plate has a flat base plate (12) with wing projections (22), which project from opposing long edges and in each of which at least one through hole (28) for a fixing screw is provided, and an elongate bracket retaining part (16) projecting from the base plate (12) between the wing projections (22).

The base plate (12) is provided in its underside facing the carcass supporting wall with a flat recess of large surface area in which a planar adjusting plate with a thickness substantially equal to the internal depth of the recess is adjustably disposed so as to be movable in at least one co-ordinate direction.

The elongate bracket retaining part (16) is disposed on the upper face of the base plate (12) opposite the adjusting plate and is connected to the adjusting plate by way of connecting elements which pass through holes in the base plate.

10 Claims, 3 Drawing Sheets

U.S. PATENT DOCUMENTS

| | | | | |
|---|---|---|---|---|
| 6,523,225 | B1 * | 2/2003 | Pecar | 16/382 |
| 6,715,180 | B2 * | 4/2004 | Mueller et al. | 16/236 |
| 6,739,019 | B2 * | 5/2004 | Schnelle et al. | 16/235 |
| 6,757,939 | B2 * | 7/2004 | Mueller et al. | 16/242 |
| 2001/0044987 | A1 | 11/2001 | Salice | |

FOREIGN PATENT DOCUMENTS

| | | | | | |
|---|---|---|---|---|---|
| DE | 2542462 | A | * | 3/1977 | E05D 7/04 |
| DE | 26 24 453 | | | 12/1977 | |
| DE | 3316048 | A1 | * | 11/1984 | E05D 7/04 |
| DE | 39 43 210 | C1 | | 6/1991 | |
| DE | 299 02 768 | U1 | | 2/2000 | |
| EP | 0 346 633 | A1 | | 5/1989 | |
| EP | 02 41 660 | B1 | | 10/1990 | |
| GB | 1526721 | A | * | 9/1978 | E05D 5/02 |
| JP | 2002194941 | A | * | 7/2002 | E05D 7/04 |
| WO | WO 8600367 | A | * | 1/1986 | E05D 3/06 |

* cited by examiner

Fig.8
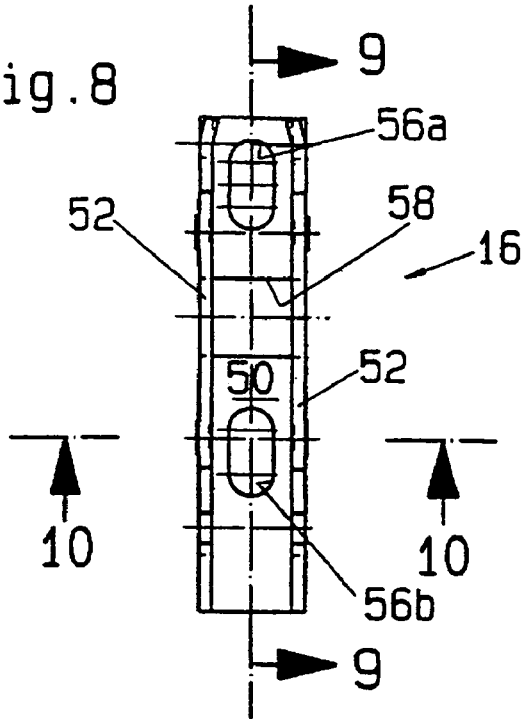
Fig.9
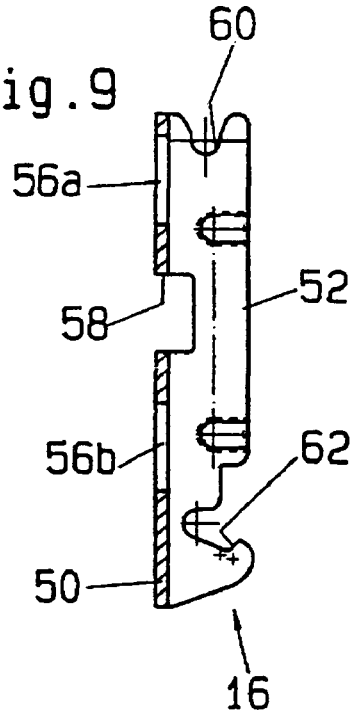
Fig.10
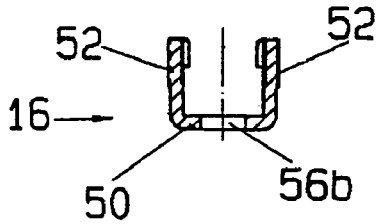
Fig.11
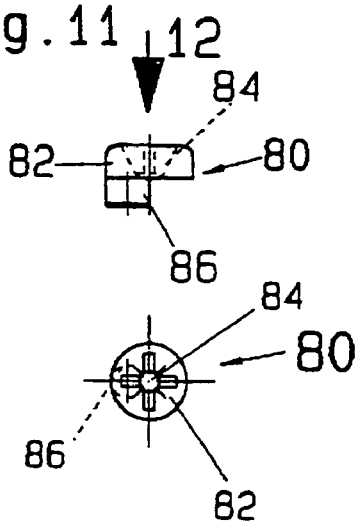
Fig.12
Fig.13
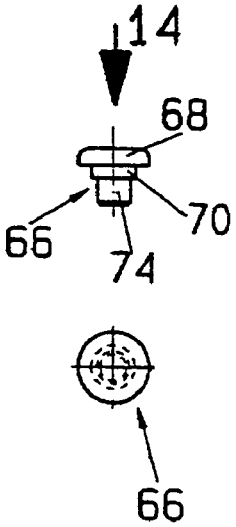
Fig.14
Fig.15
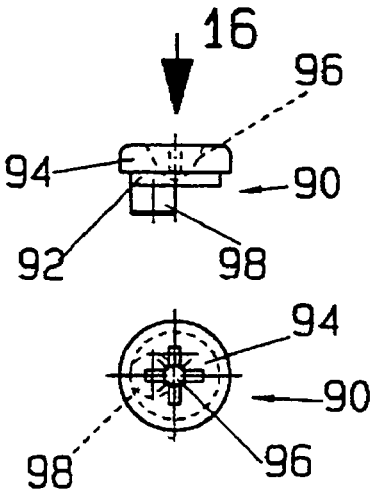
Fig.16

MOUNTING PLATE FOR ADJUSTABLY RETAINING FURNITURE HINGES ON THE BODY OF PIECES OF FURNITURE

The invention relates to a mounting plate which can be fixed on the supporting wall of the carcass of a piece of furniture for adjustably retaining the bracket of a furniture hinge, wherein the said mounting plate has a flat base plate with wing projections, which project from opposing long edges and in each of which at least one through hole for a fixing screw is provided, and an elongate bracket retaining part projecting from the base plate between the wing projections, whereby the base plate is provided in its underside facing the carcass supporting wail with a flat recess of large surface area in which a planar adjusting plate with a thickness substantially equal to the internal depth of the recess is adjustably disposed so as to be movable in at least one co-ordinate direction, the elongate bracket retaining part is disposed on the upper face of the base plate opposite the adjusting plate and is connected to the adjusting plate by way of connecting elements which pass through holes in the base plate, and the adjusting plate is movable in the first direction of adjustment of the bracket retaining part but is guided in the recess of the base plate so as to be secured against movement in other adjustment directions, and whereby the regions of the connecting elements which connect the bracket retaining part to the adjusting plate are guided through slot-like through holes in the base plate which extend in the direction of displacement.

Such mounting plates, which are provided with wing projections and are therefore often referred to briefly as "wing plates", have been introduced increasingly in recent years for use in modular and add-on cupboards and shelving units which are provided (DE 26 24 453 A1) in their side or intermediate walls in the front and rear region with rows of holes of regular pitch of for example 32 mm originally intended only to receive compartment base supports. The bores of the rows of bores on the outside of the carcass have recently been used to an increasing extent additionally as fixing bores for the mounting plates under consideration here, so that the provision of separate fixing bores for the mounting plates is superfluous. The possibilities provided in the case of modern furniture hinges for adjusting the hinge for alignment of the door leaf relative to the cupboard carcass in the vertical direction and horizontally in the direction of the cupboard depth for alignment of neighboring door leaves on the one hand and for setting the smallest possible gap between the inner face of a—closed impinging door leaf and the end faces of the cupboard carcass must also be provided in this case. For adjustment in the vertical direction slots extending in the direction of adjustment are provided as a rule in the wing projections, and when the fixing screw is loosened these slots allow a displacement of the previously mounted mounting plate in the vertical direction. For the adjustment of the size of the gap between the inner face of a door leaf and the front edges of the carcass, as a rule hinges which are known on all of the possible adjustment means are provided on the mounting plate. The aforementioned vertical adjustment by displacement of the mounting plate in the vertical direction when the fixing screws are loosened has the disadvantage on the one hand that an adjustment made while the fixing screws are still loose is not secured, so that unwanted changes in the desired position can occur. Furthermore the fixing of the wing plate in a position displaced relative to the original fixing will leave visible unattractive impressions or damage to the surface of the cupboard supporting wall in the previous fixing area.

In addition, the mounting of the bracket of hinges on the associated mounting plate by a latching mechanism has been increasingly successful in recent years, but does not readily allow subsequent adjustment in the direction of the carcass depth (DE 299 02 768 U1). In the case of normal hinges this depth adjustment is made possible by the division of the mounting plate itself into two mounting plate parts which are adjustable relative to one another in the desired direction of adjustment and can then be fixed in selectable relative positions to one another. In each case, however, the overall thickness of the mounting plates is increased, which is also undesirable.

The object of the invention, therefore, is to make further developments to the known mounting plates constructed as flange plates in such a way that the required adjustability in the vertical direction and/or in the direction of the carcass depth is also provided, but the disadvantages of the known mounting plates which are set out above are avoided.

Starting from a mounting plate of the type referred to in the introduction, this object is achieved according to the invention in that the connecting elements are constructed like shanks in the regions which pass through the slot-like through holes and additionally are guided through slot-like through holes in the bracket retaining part which extend at right angles to the first direction of adjustment of the bracket retaining part, so that the bracket retaining part is retained on the base plate so that it is displaceable relative to the base plate by the amount predetermined by the length of the slot-like through holes in a second direction of adjustment extending at right angles to the first direction of adjustment. Therefore in the case of an adjustment of a hinge bracket fixed on the bracket retaining part it is not necessary to loosen the fixing screws f the base plate on the carcass supporting wall, since only a displacement between the base plate and the adjusting plate provided on the carcass wall takes plate. Thus superficial damage to the carcass wall which occurred on initial assembly cannot be visible.

In a preferred embodiment the slot-like through holes which make possible the displacement of the adjusting plate relative to the base plate in the first direction of adjustment are provided extending at right angles to the longitudinal extent of the bracket retaining part in the base plate.

The slot-like through holes which make possible the displacement of the bracket retaining part relative to the base plate in the second direction of adjustment are then provided extending at right angles to the longitudinal extent of the bracket retaining part in the bracket retaining part.

Alternatively, the slot-like through holes which make possible the displacement of the adjusting plate relative to the base plate in the first direction of adjustment can also be disposed extending in the direction of the longitudinal extent of the bracket retaining part in the base plate.

The slot-like through holes which make possible the displacement of the bracket retaining part relative to the base plate in the second direction of adjustment are then provided extending at right angles to the longitudinal extent of the bracket retaining part in this bracket retaining part.

For forcible adjustment of the base plate relative to the adjusting plate in the first direction of adjustment, in a further development according to the invention an eccentric component can be provided which is rotatably mounted in the adjusting plate and engages on the opposing long edges of a slot in one of the wing projections of the base plate.

For forcible adjustment of the bracket retaining part relative to the base plate in the second direction of adjustment, an eccentric component can be provided which is rotatably mounted in the adjusting plate and engages on the opposing long edges of a break-through in the bracket retaining part.

The eccentric component or the eccentric components are then advantageously each provided with a bearing journal which is rotatably mounted in a bore of the adjusting plate and to which is connected a cylindrical eccentric portion lying within the associated slot and having a diameter substantially corresponding to the width of the associated slot or break-through in the wing projection or the bracket retaining part respectively, whereby the central longitudinal axis of the eccentric portion extends offset by half the dimension of the respectively provided adjustment path relative to the central longitudinal axis of the bearing journal.

Means for application of a tool, e.g. screwdriver slots, cross-slots, square heads or hexagonal heads, etc., are advantageously provided in the upper end face of the respective eccentric component remote from the adjusting plate. Alternatively a handle can be provided on the upper end of the respective eccentric component remote from the adjusting plate, thus making it possible to adjust the bracket retaining part on the base plate without a tool.

In a preferred embodiment of the invention the bracket retaining part is constructed as an elongate metal profiled member of substantially U-shaped cross-section which is disposed so that it rests with its web wall on the upper face of the base plate, whereby parallel side walls project upwards at right angles from the lateral long edges of the web wall and when the hinge is mounted they engage between the inner faces of the flanks of the hinge bracket.

The distance measured over the outer faces of the side walls of the bracket retaining part which point away from one another is substantially equal to the internal dimension between the flanks of an appertaining hinge bracket, whereby in the front end region of the side walls on the door leaf side receptacles are provided for the attachment of connecting projections provided on the hinge bracket and in the end region of the side walls remote from the door leaf detents are provided for engagement of the latching surface of a latching element which is resiliently biased on the hinge bracket. Thus with this configuration of the mounting plate the use of the new hinge which can be mounted on the mounting plate or removed without a tool by means of a latching mechanism.

The invention is explained in greater detail in the following description of an embodiment in conjunction with the drawings, in which:

FIG. 8 shows a plan view of the bracket retaining part of the mounting plate according to FIGS. 1 to 3;

FIG. 9 shows a sectional view viewed in the direction of the arrows 9—9 in FIG. 8;

FIG. 10 shows a sectional view viewed in the direction of the arrows 10—10 in FIG. 9;

FIG. 11 shows a side view of an eccentric component provided for adjustment of the bracket retaining part on the base plate;

FIG. 12 shows a plan view of the eccentric component viewed in the direction of the arrow 12 in FIG. 11;

FIG. 13 shows a side view of a connecting element which connects the bracket retaining part to the adjusting plate;

FIG. 14 shows a plan view of the connecting element viewed in the direction of the arrow 14 in FIG. 13;

FIG. 15 shows a further eccentric component which makes displacement of the adjusting plate relative to the base plate possible; and FIG. 16 shows a plan view of the eccentric component viewed in the direction of the arrow 16 in FIG. 15.

Figure 1:
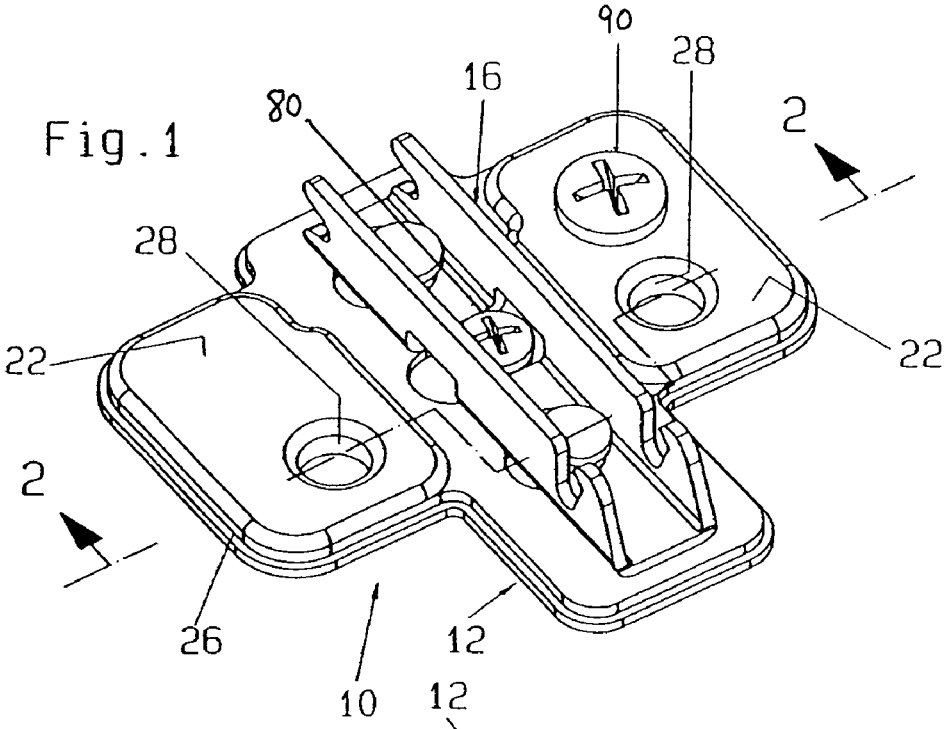
FIG. 1 shows a perspective view of a mounting plate according to the invention constructed as a wing plate.
Figure 3:
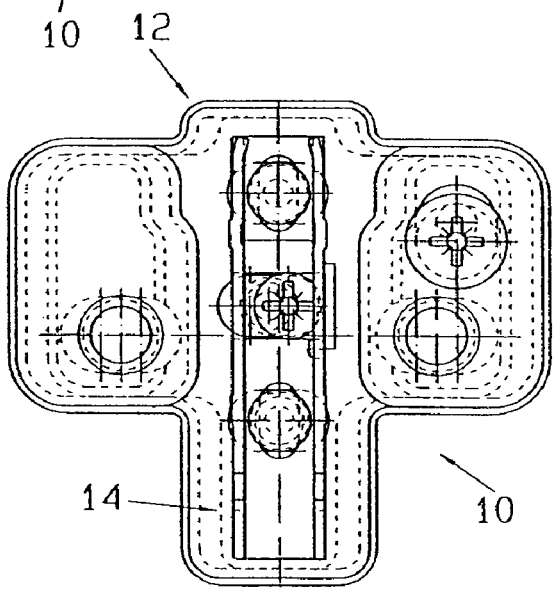
FIG. 3 shows a plan view of the mounting plate viewed in the direction of the arrow 3 in FIG. 2.
Figure 2:
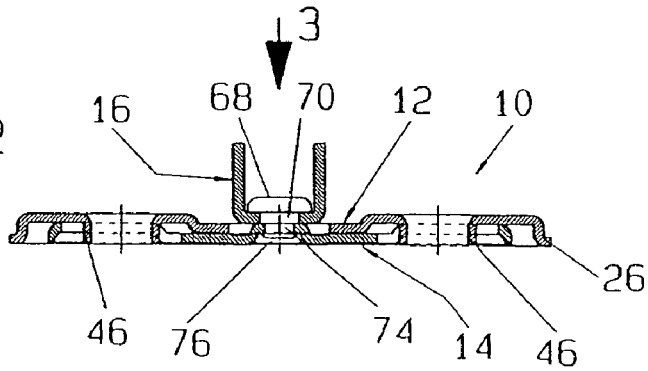
FIG. 2 shows a sectional view along the section line represented by the arrows 2—2 in FIG. 1.
Figure 6:
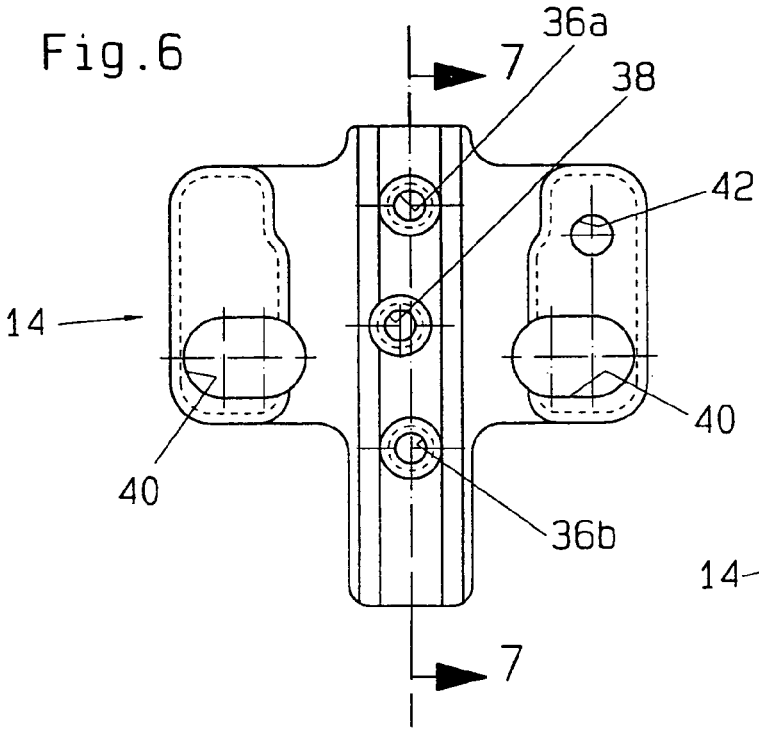
FIG. 6 shows a plan view of the adjusting plate of the mounting plate shown in FIGS. 1 to 3.
Figure 7:
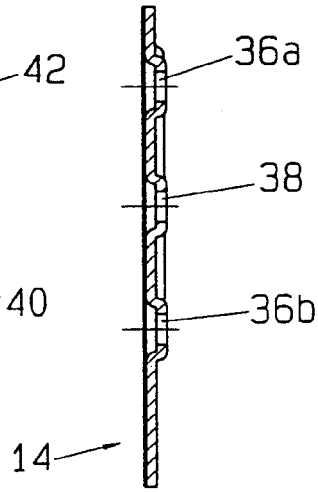
FIG. 7 shows a sectional view viewed in the direction of the arrows 7—7 in FIG. 6.

The mounting plate shown in FIGS. 1 to 3 and designated overall by 10 consists essentially of three principal parts, namely a base plate 12 (FIGS. 4 and 5), an adjusting plate (FIGS. 6 and 7) and a bracket retaining part 16 (FIGS. 8 to 10).

Figure 4:
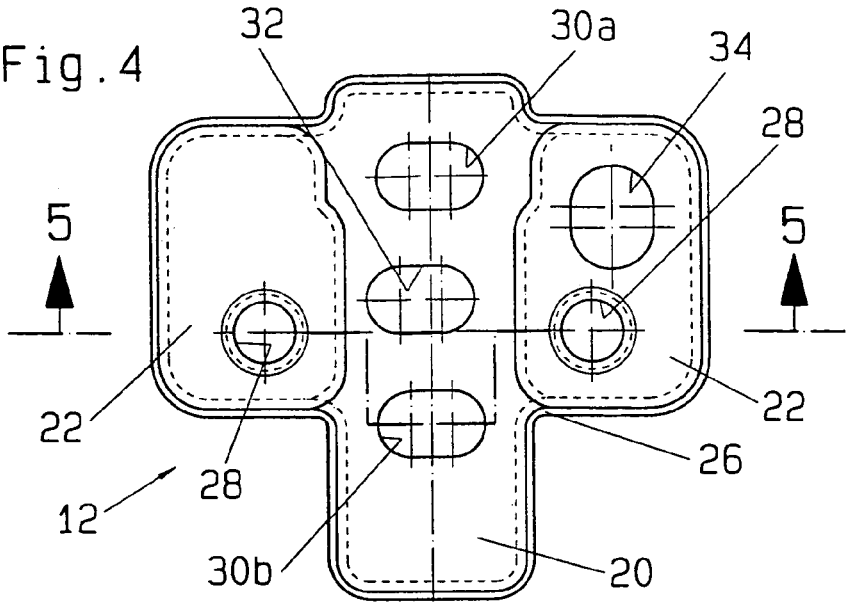
FIG. 4 shows a plan view of the base plate of the mounting plate according to FIGS. 1 to 3.

The base plate 12 which in the illustrated case is produced from sheet metal using a stamping press process has, as can be seen in particular in FIG. 4, an elongate middle portion 20 with wing projections 22 cut integrally on its lateral long edges and projecting in opposite directions.

The base plate is shaped in such a way that in its underside it has a low recess 24 which is closed off by a narrow peripheral edge strip 26 which in the proper fixing position of the mounting plate 10 on the supporting wall of a cupboard carcass rests on the supporting wall.

Each wing projection 22 has a necked through opening 28 for the passage of the shank of a fixing screw (not shown). In the middle portion 20 of the base plate 12 a plurality of slot-like through holes 30*a*, 30*b* and 32 are provided which are spaced from one another in the longitudinal direction, and additionally in the wing projection 22 shown on the right in the drawing a slot 34 which extends parallel to the longitudinal extent of the middle portion 20 is provided above the fixing bore 28.

The adjusting plate 14 to be disposed in the recess 24 in the underside of the base plate 12 has, when the base plate is viewed in plan view, a similar external contour with smaller cross-sectional dimensions, so that the adjusting plate 14 is movable in the transverse direction in the recess 24, whereby the size of the displacement path is predetermined by the difference in dimensions between the internal dimensions of the recess 24 and the outer dimensions of the adjusting plate 14.

In the regions below the slot-like holes 30*a*, 30*b* and 32 the adjusting plate 14 is provided with through bores 36*a*, 36*b* and 38 countersunk on the underside. Below the fixing openings 28 transversely extending slots 40 are stamped into the regions lying below the wing projections 22 of the base plate 12 and allow the transverse displacement of the adjusting plate 13 relative to the base plate 12, even when the shanks of fixing screws are passed through the fixing openings 28 and the slots 40. Below the slot 34 provided in the right-hand wing projection 22 a cylindrical bore is made in the adjusting plate 14 and countersunk on the underside.

Figure 5:
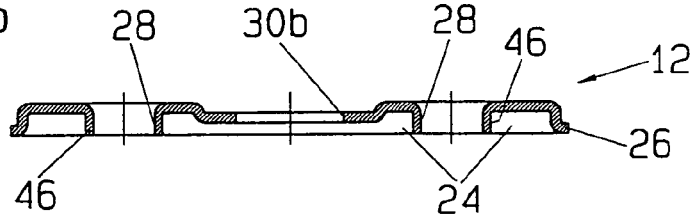
FIG. 5 shows a sectional view of the base plate along the section line represented by the arrows 5—5 in FIG. 4.

As can be seen in FIG. 5, the fixing openings 28 are each delimited by a cylindrical collar 46 which enters the interior of the recess 24 and on the underside closes off the base plate 12 flush with the peripheral edge strip 26. These collars 46 have an external diameter which corresponds to the width of the slots 40 in the adjusting plate 14. Thus the collars 46 constitute guide elements for the adjusting plate 14 which make a displacement of the adjusting plate relative to the base plate 12 possible only in the transverse direction, i.e. in the direction of the slot-like through holes 30*a*, 30*b* and 32 in the base plate as well as the slots 40 in the adjusting plate 14.

The bracket retaining part 16 which in the present case is also stamped out of metal sheet and then pressed or bent into shape has a substantially planar web wall 50 which can be placed on the upper face of the base plate 12 and in which a side wall 52 is bent away from each of its long edges so that the retaining part 16 has the substantially U-shaped cross-sectional shape which can be seen in FIG. 10. In this case the width of the retaining part 16 measured over the outer faces of the side walls 52 is chosen so that it corresponds approximately to the clear distance between the flanks of the bracket of a hinge to be fixed on the mounting plate 10. In the web face 50 two longitudinally extending slots 56*a*, 56*b* are provided which are spaced in the longitudinal direction and which in the ready-mounted hinge 10 are aligned with the through holes 30*a*, 30*b* respectively of the base plate 12 and the bores 36*a*, 36*b* respectively of the adjusting plate 14. Between the slots 56*a* and 56*b* a transversely extending break-through 58 which extends over the entire width thereof and a little further into the two side: walls 52 is stamped into the web wall 50, and in the proper mounting position of the mounting plate the said break-through lies above the slot-like through hole 32 in the base plate and the cylindrical bore 38 in the adjusting plate 14.

In the end regions of the side walls 52 which lie uppermost in FIGS. 8 and 9 there are provided open receptacles 60 into which can be fitted a transversely extending pin in the bracket of an associated hinge to be mounted on the mounting plate 10. In the rear regions of the side walls 52 which are at the bottom in FIGS. 8 and 9 detents 62 are formed by stamping out and on them counterpart detents of a resiliently biased latching element provided on the hinge bracket can be brought into engagement. The type and manner of the fixing of the hinge brackets by latching on an elongate middle part of a mounting plate is basically known (e.g. from DE 299 02 768 U1 which was referred to in the introduction) and therefore will not be explained in detail here.

In FIGS. 13 and 14 a connecting element 66 is shown which—together with a further similar connecting element with the mounting plate 10 ready mounted—connects the bracket retaining part 16 to the adjusting plate 14 in the manner shown in FIG. 2, whereby the base plate 12 lies between the bracket retaining part 16 and the adjusting plate 14. The connecting element 66 has a flat upper head part 68 of defined circular shape, the diameter of which is greater than the width of the slot-like through holes 56*a*, 56*b* in the web wall 50 of the bracket retaining part 16. On the underside of the head part 68 is attached a short shank part 70 of defined circular cross-sectional shape, the diameter of which is approximately equal to or only slightly smaller than the width of the slot-like through holes 56*a*, 56*b*. A lug 74 of circular cross-sectional shape which is further reduced in diameter is formed on the lower end face of the shank part 70 remote from the head part and, when the mounting plate 10 ready mounted, passes through one of the bores 36*a*, 36*b* in the adjusting plate, the free end of the said lug then being deformed by application of a pressing force or by flanging on the underside of the adjusting plate to form a rivet head 76 (FIG. 2). Thus the bracket retaining part 16 and the adjusting plate 14, which—as mentioned—are connected by two connecting elements 66 in the longitudinal direction of the supporting wall retaining part in the described manner, are undetachably retained don the upper face or the underside respectively of the base plate, but a displacement of the supporting wall retaining part 16 relative to the base plate 12 and to the adjusting plate 14 is possible by the adjustment amount predetermined by the length of the slot-like through holes 56*a*, 56*b*. On the other hand a perceptible displacement of the supporting wall retaining part 14 relative to the adjusting plate 14 in the transverse direction is not possible, because the diameter of the shank part 70 corresponds to the width of the slot-like through holes 56*a*, 56*b*. However, transverse displacement of the bracket retaining part 16 jointly with the adjusting plate 14 relative to the base plate 12 is possible due to the transversely extending slot-like through holes 30*a*, 30*b* in the base plate. The amount of adjustment in the transverse direction is in turn determined by the length of the through holes 30*a*, 30*b* measured in the transverse direction.

FIGS. 11 and 12 show an eccentric component 80 which has a circular eccentric portion 82 in the upper face of which a cross-slot 84 s formed for the application of a Phillips screwdriver, whilst a lug 86 which is offset from the centre point of the eccentric portion 82 projects from the underside and, when the mounting plate is ready mounted, is guided through the slot-like through hole 32 in the base plate 12 into the bore 38 in the adjusting plate 14 and is rotatably mounted in this bore 38. A rivet head 88 (not shown) formed on the lower end of the lug 86 then in turn ensures that the lug 86 cannot come out of the bore 38 unintentionally.

The diameter of the eccentric portion 82 is substantially equal to the width o the break-through 58 measured in the longitudinal direction of the bracket retaining part 16, so that the circumferential surface of the eccentric portion 82 is supported on the opposing transversely extending edges of the break-through 58. With a rotation of the eccentric portion 82 by means of a screwdriver inserted into the cross-slot 84 the eccentric portion 82 alters its position relative to the adjusting plate and displaces the bracket retaining part correspondingly. Thus in this way it is possible to position the supporting wall retaining part 16 relative to the base plate 12 in the longitudinal direction forcibly and in such a way that in a chosen position it is self-locking to secure it against further adjustment.

The independent adjustment of the bracket retaining part 16 on the base plate in the transverse direction is effected by means of a further eccentric component 90 which is shown in FIGS. 15 and 16. The eccentric component 90 again has a low flat eccentric portion 92 of defined circular shape, on the upper face of which there is provided an actuating head 94 of larger diameter with a cross-slot 96 for a Phillips screwdriver. Off-centre of the eccentric portion 92 a lug 98 is attached to the underside thereof, whereby the said lug engages in the cylindrical bore 42 of the adjusting plate 14 and a rivet head of enlarged diameter constructed there is again retained in its lower countersinking. When the mounting plate 10 is mounted the eccentric portion 92 butts so as to fit against the lateral long edges of the slot-like through hole 34 of the base plate 12. If the eccentric component is rotated by means of a screwdriver inserted into the cross-slot, the position of the eccentric portion 92 relative to the adjusting plate 14 changes and this latter is displaced correspondingly in the transverse direction by the support of the circumference of the eccentric portion in the through hole 34. Thus by rotation of the eccentric component 90 a transverse adjustment of the bracket retaining part 16 on the base plate 12 is possible independently of the longitudinal positioning of the said retaining part, and again this is forcible and self-locking.

What is claimed is:

1. Mounting plate for adjustably retaining a bracket of a furniture hinge, said mounting plate comprising:

a flat base plate for fastening to a supporting wall of a carcass of a piece of furniture, said flat base plate having wing projections which project outward from opposing lateral sides, each of the wing projections having a through-hole for receiving a fixing screw, and a first set of slot-like through-holes situated centrally and longitudinally in said flat base plate, wherein each of the through-holes in the first set extends laterally;

an elongate bracket-retaining part situated along a longitudinal center line on an upper face of the base plate and projecting upward between the wing projections, and connected to said flat base plate by connecting elements, said elongate bracket-retaining part being provided with a second set of slot-like through-holes situated centrally and longitudinally, wherein each of the through-holes in the second set extends longitudinally; and a planar adjusting plate which is movable in at least one coordinate direction and adjustably disposed in a flat recess which is provided on a lower face of the base plate, wherein the planar adjusting plate is connected to said flat base plate by the connecting elements and has a thickness which is substantially equal to an internal depth of the flat recess;

wherein the connecting elements comprise regions which are shank-shaped and each of the connecting elements has a diameter which is substantially equal to the width of each of the slot-like through-holes of the second set;

wherein the planar adjusting plate is moveable to a first position of adjustment in the elongate bracket-retaining part, and is guidable along the flat recess to restrict movement to the first position of adjustment, and wherein the elongate bracket-retaining part is displaceable relative to the flat base plate to a second position of adjustment which extends at right angles to the first position, said elongate bracket-retaining part being displaceable by an amount predetermined by the diameter of each of the slot-like through-holes of the second set.

2. Mounting plate as claimed in claim 1, wherein each of the holes of the first set of slot-like through-holes which allows for displacement of the planar adjusting plate relative to the flat base plate in the first position of adjustment extends at right angles to a longitudinal length of the elongate bracket-retaining part.

3. Mounting plate as claimed in claim 1, wherein each of the holes of the second set of slot-like through-holes in the elongate bracket-retaining part which allows for displacement of the elongate bracket-retaining part relative to the flat base plate in the second position of adjustment extends parallel to a longitudinal length of the elongate bracket-retaining part.

4. Mounting plate as claimed in claim 1, wherein at least one eccentric component is provided which is rotatably mounted on the planar adjusting plate and engages the opposing long edges of a slot in one of the wing projections of the flat base plate for forcible adjustment of the flat base plate relative to the planar adjusting plate in the first position of adjustment.

5. Mounting plate as claimed in claim 4, wherein a second eccentric component is provided which is rotatably mounted on the planar adjusting plate and engages the opposing long edges of a break-through in the elongate bracket-retaining for forcible adjustment of the flat base plate relative to the planar adjusting plate in the second position of adjustment.

6. Mounting plate as claimed in claim 4, wherein the at least one eccentric component comprises a bearing journal which is rotatably mounted in a bore of the planar adjusting plate and a cylindrical eccentric portion connected thereto disposed within the slot of the wing projection having a diameter substantially corresponding to a width of the slot wherein the bearing journal extends to half of a dimension of the cylindrical eccentric portion along their respective central longitudinal axes.

7. Mounting plate as claimed in claim 4, wherein means for application of a tool are provided in an upper end face of the at least one eccentric component remote from the planar adjusting plate.

8. Mounting plate as claimed in claim 4, wherein a handle is provided on an upper end of the at least one eccentric component remote from the planar adjusting plate.

9. Mounting plate as claimed in claim 1, wherein the elongate bracket-retaining part is an elongate metal profiled member having a transverse wall, a pair of substantially parallel sidewalls separated by a distance, and a substantially U-shaped cross-section which is disposed so that the transverse wall is on the upper face of the base plate, whereby the substantially parallel side walls project upwards at right angles from the lateral long edges of the transverse wall.

10. Mounting plate as claimed in claim 9, wherein the distance between the outer faces of the side walls which point outwardly from each other is substantially equal to the distance between the flanks of an appertaining hinge bracket to be fixed on said mounting plate, wherein the sidewalls have a front end region pointing out of the interior of the carcass and a rear end region pointing into the interior of the carcass, wherein said front end region is provided with a leaf side receptacle for attaching connecting projections on the hinge bracket, wherein said end region is provided with a leaf detent for engaging latching elements of a resiliently biased latching element on the hinge bracket.

* * * * *